US007171136B2

(12) United States Patent
Wayman

(10) Patent No.: US 7,171,136 B2
(45) Date of Patent: Jan. 30, 2007

(54) POWER SUPPLY FOR HYBRID SCAVENGELESS DEVELOPMENT TYPE IMAGE FORMING SYSTEM

(75) Inventor: William H. Wayman, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 264 days.

(21) Appl. No.: 10/761,209

(22) Filed: Jan. 22, 2004

(65) Prior Publication Data

US 2005/0163521 A1 Jul. 28, 2005

(51) Int. Cl.
*G03G 15/00* (2006.01)
*G03G 15/08* (2006.01)

(52) U.S. Cl. ..... 399/88; 399/266

(58) Field of Classification Search ..... 399/88, 399/266

See application file for complete search history.

(56) References Cited

U.S. PATENT DOCUMENTS 5,206,693 A * 4/1993 Folkins ..... 399/291
5,943,539 A 8/1999 Hirsch et al.
5,978,633 A 11/1999 Hirsch et al.
5,987,633 A 11/1999 Newman et al.
6,049,686 A 4/2000 Folkins et al.
6,101,357 A 8/2000 Wayman
2003/0185598 A1 10/2003 Folkins et al.

FOREIGN PATENT DOCUMENTS

EP 0 533 347 A2 3/1993

OTHER PUBLICATIONS

European Search Report.

* cited by examiner

*Primary Examiner*—William J. Royer
(74) *Attorney, Agent, or Firm*—Oliff & Berridge, PLC

(57) ABSTRACT

A power supply for a hybrid scavengeless development (HSD) image forming system which generates three voltages, a mag voltage, a donor voltage and a wire electrode voltage. The power supply outputs square waveforms for generating toner clouds to maximize the voltage push-pull on toner without increasing peak voltage level. The power supply also generates asymmetric waveforms for mag AC, donor AC and electrode wire voltage signals to avoid air breakdown at a wire electrode to donor interface while allowing maximum use of a voltage space. Finally, the power supply uses frequency modulation of the AC signals to suppress harmonic strobing of electrode wires.

17 Claims, 5 Drawing Sheets

POWER SUPPLY FOR HYBRID SCAVENGELESS DEVELOPMENT TYPE IMAGE FORMING SYSTEM

BACKGROUND OF THE INVENTION

1. Field of Invention

This invention relates to the field of electrophotographic image forming systems and power supplies used therewith.

2. Description of Related Art

Hybrid Scavengeless Development (HSD) is a process for ionographic or electrophotographic imaging and printing apparatuses designed to prevent scavenging of toner from a photoreceptor of an imaging device by subsequent development stations.

In general, the process of electrophotographic printing includes charging a photoconductive member to a substantially uniform potential to sensitize the photoconductive surface. The charged photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a substrate such as a copy sheet. Finally, the toner powder image is heated to permanently fuse it to the substrate in image configuration.

The electrophotographic marking process discussed above can be modified to produce color images. One color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the photoreceptor, a previously toned image will be scavenged by subsequent development if interacting development systems are used. Thus, for the IOI process, there is a need for scavengeless or non-interactive development systems. For a thorough description of scavengeless development see U.S. Pat. No. 5,031,570, hereby incorporated by reference in its entirety.

Hybrid scavengeless development technology deposits toner via a conventional magnetic brush onto the surface of a donor roll and a plurality of electrode wires are closely spaced from the toned donor roll in a development zone. An AC voltage is applied to the electrode wires to generate a toner cloud in the development zone. This donor roll generally consists of a conductive core covered with a thin (50–200 μm) partially conductive layer. The donor roll is held at an electrical potential difference relative to the conductive core to produce a field necessary for toner development. A toner layer on the donor roll is disturbed by electric fields from a wire or set of wires to produce and sustain an agitated cloud of toner particles. Typical AC voltages of the wires relative to the donor roll are 600–900 Vpp at frequencies of 5–15 kHz. These AC signals are often square waves, rather than pure sinusoidal waves. Toner from the cloud is then developed onto the nearby photoreceptor by fields created by a latent image.

A problem inherent to developer systems using wires is a vibration of the wires parallel to the donor roll and photoreceptor surfaces. This wire vibration manifests itself in a density variation, at a frequency corresponding to the wire vibration frequency, of toner on the photoreceptor. Also, higher harmonics of vibration, being an integer multiple of the wire fundamental frequency, can be excited by the applied voltage frequency. Again these vibrations can cause a density variation, at a frequency corresponding to the wire vibration frequency to produce density variations that correspond to harmonic standing wave patterns, of toner on the photoreceptor. The toner density variations and the wire vibrations that cause them are lumped together into a problem with the generic name of "strobing." More specifically, fundamental strobing is the term used to describe the vibration and print defect associated with the fundamental mode of vibration, while harmonic strobing is used to describe the defect caused by the higher harmonics. Strobing does not occur at all hardware setpoints. For instance, it can often be reduced by decreasing the amplitude of the wire voltage, or varying the donor roll speed. Also, fundamental strobing is related to the applied wire frequency in a complex manner, and both types of strobing are sensitive to the frictional properties of the toner.

SUMMARY OF THE INVENTION

In various exemplary embodiments according to this invention, a power supply is separately provided for an HSD image forming system which includes frequency deviation capability for avoidance of wire strobing defects.

In various exemplary embodiments according to this invention, a power supply is separately provided for an HSD image forming system which uses square waves instead of sinusoidal waves in generating toner clouds to increase the average voltage applied to the toner without increasing the peak voltage.

In various exemplary embodiments according to this invention, a power supply is separately provided for an HSD image forming system which uses relatively low amplitude AC voltages, thus reducing power consumption and stress on toner concentration sensors.

In various exemplary embodiments according to this invention, a power supply is separately provided for an HSD image forming system which utilizes asymmetric waveforms.

The systems and methods according to this invention provide a power supply for a hybrid scavengeless development electrophotographic image forming system in which the donor roll and the wires are operated at the same AC voltage frequency without phase shifts, allowing the donor roll to be run at a higher voltage.

DETAILED DESCRIPTION OF PREFERRED EMBODIMENTS

Figure 1:
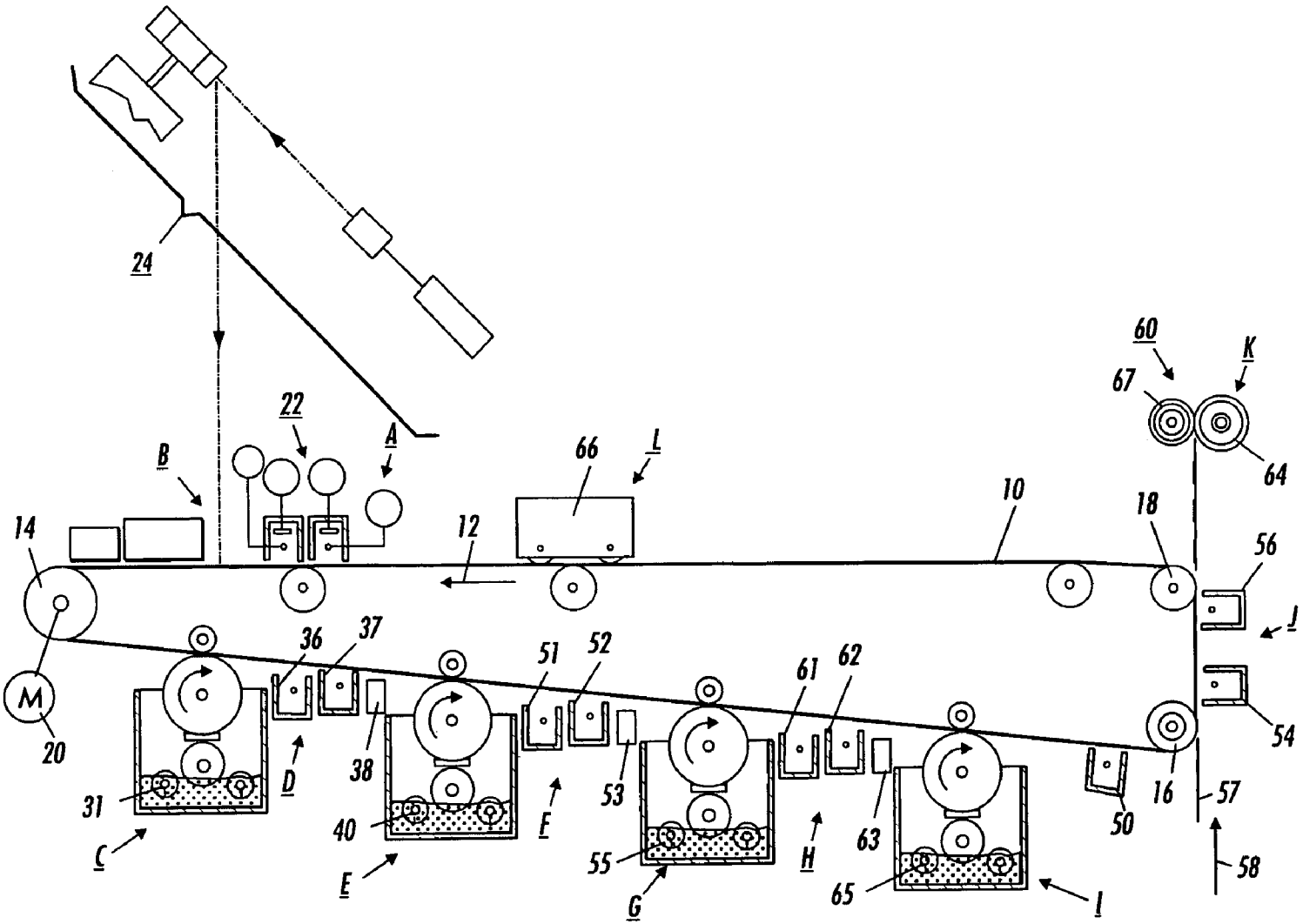
FIG. 1 is a schematic view of an exemplary four color electrophotographic image forming device.

Referring initially to FIG. 1, there is shown an exemplary electrophotographic machine usable with the power supply according to this invention. An electrophotographic image forming device creates a color image in a single pass through the machine. The image forming device uses a charge retentive surface in the form of, for example, an Active Matrix (AMAT) photoreceptor belt 10 which travels sequentially through various process stations in the direction indicated by the arrow 12. Belt travel is brought about by mounting the photoreceptor belt 10 about a drive roller 14 and two tension rollers 16 and 18 and then rotating the drive roller 14 via a drive motor 20.

As the photoreceptor belt 10 moves, each part of it passes through each of the subsequently described process stations. For convenience, a single section of the photoreceptor belt 10, referred to as the image area, is identified. The image area is that part of the photoreceptor belt 10 which is to receive toner powder images that, after being transferred to a substrate, produce the final image. While the photoreceptor belt 10 may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential. As an example, the image area will be charged to a uniform potential of about −500 volts. In practice, this is accomplished by charging the image area slightly more negative than −500 volts so that any resulting dark decay reduces the voltage to the desired −500 volts. While this description refers to the image area as being negatively charged, it could be positively charged if the charge levels and polarities of the toners, recharging devices, photoreceptor, and other relevant regions or devices are appropriately changed.

After passing through the charging station A, the now charged image area passes through a first exposure station B. At first exposure station B, the charged image area is exposed to light which illuminates the image area with a light representation of a first color (say black) image. That light representation discharges some parts of the image area so as to create an electrostatic latent image. While the illustrated embodiment uses a laser-based output scanning device 24 as a light source, it is to be understood that other light sources, for example an LED printbar, can also be used with the principles of the present invention. In various exemplary embodiments, a voltage level of about −500 volts will exist on those parts of the image area which were not illuminated, while a voltage level of about −50 volts will exist on those parts which were illuminated. Thus after exposure, the image area has a voltage profile comprised of relative high and low voltages.

After passing through the first exposure station B, the now exposed image area passes through a first development station C which is identical in structure with development stations E, G, and I. The first development station C deposits a first color, say black, of negatively charged toner 31 onto the image area. That toner 31 is attracted to the less negative sections of the image area and repelled by the more negative sections. The result is a first toner powder image on the image area. It should be understood that one could also use positively charged toner if the exposed and unexposed areas of the photoreceptor belt 10 are interchanged, or if the charging polarity of the photoreceptor belt 10 is made positive. In addition, it may be advantageous to first deposit a color other than black on the photoreceptor belt 10.

Figure 2:
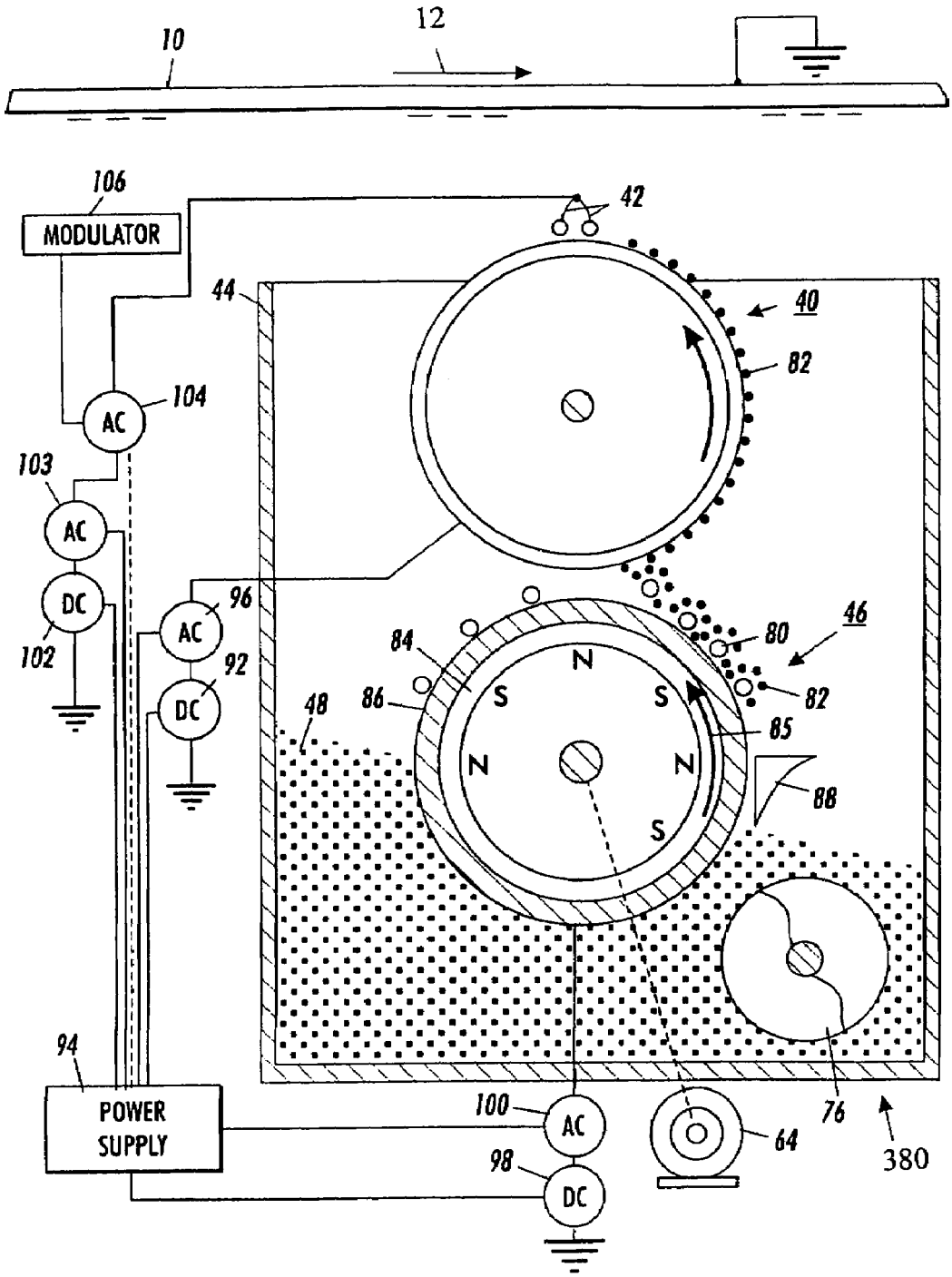
FIG. 2 is a detailed schematic view of a single color station in an exemplary multi-color scavengeless electrophotographic image forming device

For the first development station C, a development system includes a donor roll 40. As illustrated in FIG. 2, electrode wires 42 are electrically biased with an AC and DC voltage relative to donor roll 40 for the purpose of detaching toner there from. This detached toner forms a toner powder cloud in the gap between the donor roll 40 and photoreceptor belt 10. Both the electrode wires 42 and the donor roll 40 are biased with DC sources 102 and 92 respectively for discharge area development (DAD). The discharged image attracts toner particles from the toner powder cloud to form a toner powder image thereon.

After the image area passes through the first development station C toner 31 (which generally represents any particular color of toner) adheres to the illuminated image area. This causes the voltage in the illuminated area to increase to, for example, about −200 volts. The non-illuminated parts of the image area remain at about the level of −500 volts.

Referring back to FIG. 1, after passing through the first development station C, the now exposed and toned image area passes to a first recharging station D. The first recharging station D is comprised of two corona recharging devices, a first recharging device 36 and a second recharging device 37. These first and second devices 36 and 37 act together to recharge the voltage levels of both the toned and untoned parts of the image area to a substantially uniform level. It is to be understood that power supplies are coupled to the first and second recharging devices 36 and 37, and to any grid or other voltage control surface associated therewith, so that the necessary electrical inputs are available for the recharging devices 36 and 37 to accomplish their task.

After the image area passes through the first recharging device 36, the image area is overcharged by the first recharging device 36 to more negative levels than that which the image area is to have when it leaves the first recharging station D. For example, the toned and the untoned parts of the image area reach a voltage level of about −700 volts. The first recharging device 36 is preferably a DC scorotron. After being recharged by the first recharging device 36, the image area passes to the second recharging device 37. The second recharging device 37 reduces the voltage of the image area, both the untoned parts and the toned parts (represented by toner 76) to the desired potential of −500 volts.

After being recharged at the first recharging station D, the now substantially uniformly charged image area with its first toner powder image passes to a second exposure station 38. Except for the fact that the second exposure station 38 illuminates the image area with a light representation of a second color image (say yellow) to create a second electrostatic latent image, the second exposure station 38 is the same as the first exposure station B. At this point, the non-illuminated areas have a potential of about −500 volts.

However, illuminated areas, both the previously toned areas denoted by the toner 76 and the untoned areas are discharged to about −50 volts.

The image area then passes to a second development station E. Except for the fact that the second development station E contains a toner 40 which is of a different color (yellow) than the toner 31 (black) in the first development station C, the second development station E is substantially the same as the first development station C. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharging device 51 overcharges the image areas to a greater absolute potential than that ultimately desired (say −700 volts) and the second corona recharging device 52, comprised of coronodes having AC potentials, neutralizes that potential to that ultimately desired.

The now recharged image area then passes through a third exposure station 53. Except for the fact that the third exposure station 53 illuminates the image area with a light representation of a third color image (say magenta) so as to create a third electrostatic latent image, the third exposure station 53 is the same as the first and second exposure stations B and 38. The third electrostatic latent image is then developed using a third color of toner 55 (magenta) contained in a third development station G.

The now recharged image area then passes through a third recharging station H. The third recharging station H includes a pair of corona recharging devices 61 and 62 which adjust the voltage level of both the toned and untoned parts of the image area to a substantially uniform level in a manner similar to the corona recharging devices 36 and 37 and recharging devices 51 and 52.

After passing through the third recharging station H the now recharged image area then passes through a fourth exposure station 63. Except for the fact that the fourth exposure station 63 illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer. After passing the corotron member 50, the four toner powder images are transferred from the image area onto a support sheet 57 at transfer station J. It is to be understood that the support sheet 57 is advanced to the transfer station J in the direction 58 by a conventional sheet feeding apparatus which is not shown. The transfer station J includes a transfer corona device 54 which sprays positive ions onto the backside of support sheet 57. This causes the negatively charged toner powder images to move onto the support sheet 57. The transfer station J also includes a detack corona device 56 which facilitates the removal of the support sheet 57 from the printing machine.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the support sheet 57. After fusing, a chute, not shown, guides the support sheet 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 2 in greater detail, development system 380 includes the donor roll 40. A development apparatus advances developer materials into development zones. The development system 380 is scavengeless. By scavengeless is meant that the developer or toner of development system 380 must not interact with an image already formed on an image receiver. Thus, the development system 380 is also known as a non-interactive development system. The development system 380 comprises a donor structure in the form of a donor roller 40. The donor roll 40 conveys a toner layer to the development zone which is the area between the photoreceptor belt 10 and the donor roll 40. A toner layer 82 can be formed on the donor roll 40 by either a two-component developer (i.e. toner 82 and carrier 80), as shown in FIG. 2, or a single-component developer deposited on donor roll 40 via a combination single-component toner metering and charging device. The development zone contains AC biased electrode wires 42 self-spaced from the donor roll 40 by the toner layer. The single-component toner may comprise positively or negatively charged toner. For donor roll loading with two-component developer, a conventional magnetic brush 46, also referred to below as "magnetic brush roll" and "mag roll," is used for depositing the toner layer onto the donor roll 40. The magnetic brush 46 includes a magnetic core 84 enclosed by a sleeve 86. The magnetic brush 46 is shown moving in a counter clockwise direction by arrow 85.

With continued reference to FIG. 2, an auger 76, is located in housing 44. Auger 76 is mounted rotatably to mix and transport developer material. The auger 76 has blades extending spirally outwardly from a shaft. The blades are designed to advance the developer material in the axial direction substantially parallel to the longitudinal axis of the shaft. A developer metering device is designated 88. As successive electrostatic latent images are developed, the toner particles within the developer material are depleted. A toner dispenser (not shown) stores a supply of toner particles. The toner dispenser is in communication with housing 44. As the concentration of toner particles in the developer material is decreased, fresh toner particles are furnished to the developer material in the chamber from the toner dispenser. The auger 76 in the chamber of the housing 44 mix the fresh toner particles with the remaining developer material so that the resultant developer material therein is substantially uniform with the concentration of toner particles being optimized. In this manner, a substantially constant amount of toner particles are maintained in the chamber of the developer housing.

The electrode wires 42 is comprised of one or more thin (e.g., 50 to 100 micron diameter) conductive wires which are lightly positioned against the toner on the donor roll 40. The distance between the wires 42 and the donor roll 40 is self-spaced by the thickness of the toner layer, which may be approximately 15 microns. The extremities of the wires 42 are supported by blocks (not shown) at points slightly above a tangent to the donor roll surface. Suitable scavengeless development systems for incorporation in the present invention are disclosed in U.S. Pat. No. 4,868,600 and in U.S. Pat. No. 6,101,357, both of which are hereby incorporated by reference in their entirety. As disclosed in the '600 patent, a scavengeless development system may be conditioned to selectively develop one or the other of the two image areas (i.e. discharged and charged image areas) by the application of appropriate AC and DC voltage biases to the wires 42 and the donor roll 40.

Referring again to FIG. 2, the developer system includes a power supply for applying AC and DC voltages to the electrode wires 42, donor roll 40 and mag roll 46. A conventional power supply is shown in FIG. 2. A DC voltage source 102 provides proper bias to the wires 42 relative to the donor roller 40. The electrode wires 42 receive AC voltages from sources 103 and 104. These sources 103 and 104 may generate different frequencies, and the resultant voltage on the wire 42 is the instantaneous sum of the AC sources 103 and 104 plus the DC source 102. The AC source 103 is often chosen to have the same frequency, magnitude, and phase as an AC source 96, which supplies the donor roll 40. Then, the voltage of the wires 42 with respect to the donor roll 40 is just that of the AC source 104 plus that of the DC source 102. The AC voltage source 104 is connected to a modulator 106 for modulating its frequency. The modulated frequency alternating voltage signal from that AC voltage source 104 is electrically connected to the electrode wires 42. If the AC voltage source 104 has a frequency output that can be controlled by an external voltage, the modulator 106 may be any suitable commercially available suitable device, such as one including a frequency generator.

While in the development system 38, as shown in FIG. 2, the AC voltage sources 104 and 103 and the DC voltage source 102 receive their power from a power supply 94, the power may likewise be received from separate power supplies. Also, DC voltage source 102 may be separate from the DC voltage sources 92 and 98 as shown in FIG. 2 or share a common voltage source. Further, the AC voltage source 104 may be separate from AC voltage sources 96, 103, and 100 as shown in FIG. 2 or share a common voltage source. Also, modulator 106 may merely modulate the signal from the AC voltage source 104 as shown in FIG. 2 or modulate any of the AC voltage sources 96, 103, or 100.

The electrical sections of FIG. 2 are schematic in nature. Those skilled in the art of electronic circuits will realize there are many possible ways to connect AC and DC voltage sources to achieve the desired voltages on electrode wires 42, donor roll 40, and magnetic brush 46.

Figure 3:
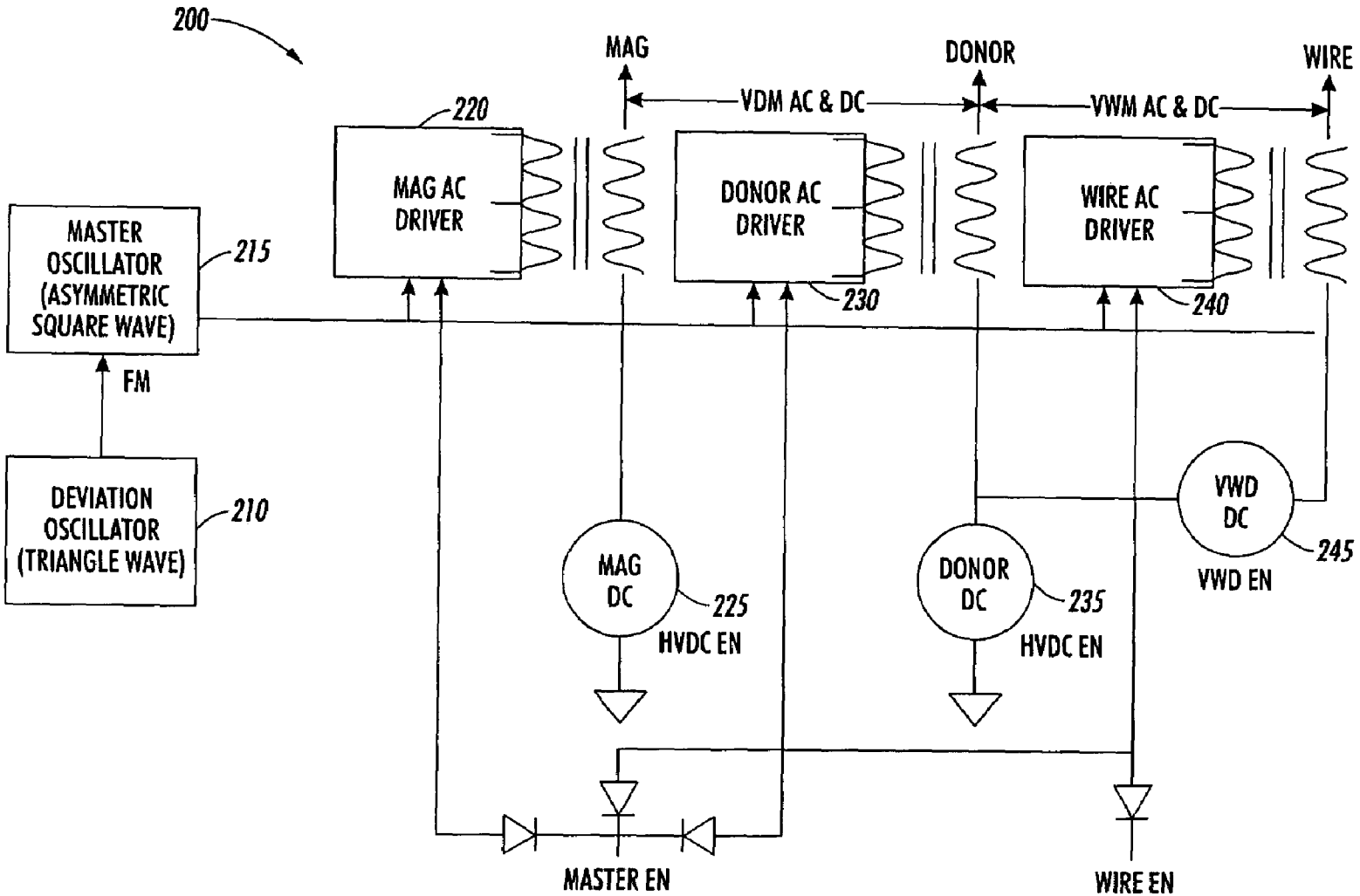
FIG. 3 is a block diagram of a power supply according to an exemplary embodiment of this invention.

Referring now to the present invention, as illustrated by FIG. 3, a power supply circuit 200 is illustrated which provides improved performance over conventional power supplies used in scavengeless development image forming systems. As illustrated in FIG. 2, at least three voltages are important in moving toner from the developer housing 44 to the photoreceptor belt 10. Specifically, these are the mag voltage, which is the voltage level $V_M$ on the mag roll 46, the donor voltage $V_D$, the voltage level on the donor roll 40 and the wire voltage $V_W$ or voltage on the electrode wires 42. The power supply circuit 200 generates three outputs for the wire, donor and mag bias voltages. In various exemplary embodiments, each voltage, the mag voltage $V_M$, the donor voltage $V_D$ and the wire voltage $V_W$, is an aggregate voltage value having an AC and a DC voltage component. More important than the actual voltage levels of the wire, donor and mag biases, are the differences between these voltages. $V_{wd}$AC is the AC difference between the wire and donor output voltages. $V_{WD}$ is the combined voltage that generates the toner cloud in proximity to the photoreceptor belt 10. $V_{DM}$DC is the voltage that loads the donor roll 40 with toner from the mag roll 46.

Referring again to FIG. 3, a deviation oscillator 210 generates a triangle wave. The triangle wave is fed to a frequency modulation (FM) input of a master oscillator 215. The master oscillator 215 generates an asymmetric square wave that is frequency modulated by the triangle wave from deviation oscillator 210. The master oscillator 215 shifts the frequency up and down by a value of, for example, two kilohertz around a fixed frequency of, for example, ten kilohertz in order to avoid harmonic strobing of the electrode wires 42 at a multiple of their harmonic frequency.

Asymmetric waves have the property that their positive voltage and negative voltage are not equal about the zero voltage axis. When a DC offset is added to a symmetric AC voltage, the applied DC shifts both the positive and negative voltages. The positive and negative values are no longer equal with respect to the zero voltage axis. The use of asymmetric waveforms allows use of all the available voltage space while avoiding air breakdown. That is to say that the magnitude of the positive voltage can be different from the negative voltage by choosing the appropriate level of asymmetry. In this way it is possible to maintain a DC offset with the same positive and negative voltage levels about the zero voltage axis. This allows use of all the available voltage space while avoiding air breakdown. Toner that has been aged by a developer housing needs the highest AC biases possible for good development latitude. Thus, using asymmetric waveforms allows the highest positive and negative voltage without the possibility of air breakdown in the air gap between the donor roll 40 and the mag 46 or the donor roll 40 and the electrode wires 42.

Square waves are advantageous in generating toner clouds in electrophotographic systems because breaking toner adhesion on donor surfaces requires high electric fields that are very close to air breakdown levels. Thus, simply increasing the amplitude of sine wave AC biases is limited by air breakdown. The use of square waves allows a longer push-pull force on the toner for the same peak voltage than do sinusoidal waves, for example.

The signal from the master oscillator 215 is then fed to each of a mag roll AC driver 220, a donor roll AC driver 230 and a wire electrode AC driver 240 to generate the AC component of the mag, donor and wire voltages. In the case of the mag voltage, the mag AC driver 220 and the mag DC power source 225 combine to charge the mag roll 46 to a voltage level $V_M$. The actual charge level of the mag roll 46 is not significant, but rather the relative AC voltage difference between the mag roll 46 and the donor roll 40, $V_{DM}$AC is significant. It is the relative voltage difference $V_{DM}$AC which causes toner to travel from the mag roll 46 to the donor roll 40.

The donor roll 40 is charged to a combined voltage value of $V_D$ by the donor AC driver 230 and the donor DC power supply 235. In various exemplary embodiments, the mag bias is set lower than the donor bias to cause the toner to be attracted to the donor roll 40 from the mag roll 46.

The electrode wires 42 are charged by the wire AC driver 240 and the donor DC power supply 235. The combined voltage Vwd 245 is the voltage which generates the toner cloud.

In the configuration of FIG. 3, voltage breakdown from the mag bias is reduced because the VdmAC is generated by the difference in donor to mag bias amplitudes. The developer housing 44 is typically made of aluminum and is electrically connected to the Mag roll circuit. The mag bias is set lower than the donor bias to obtain the desired VdmAC. Minimizing the mag peak bias voltage is desirable to avoid voltage breakdown which can damage thermoelectric coolers, temperature or toner concentration sensors located close to the mag roll 46, or developer housing 44. In the power supply circuit of FIG. 3, the donor roll 40 and the electrode wires 42 are run at the same frequency without phase shifts.

Figure 4:
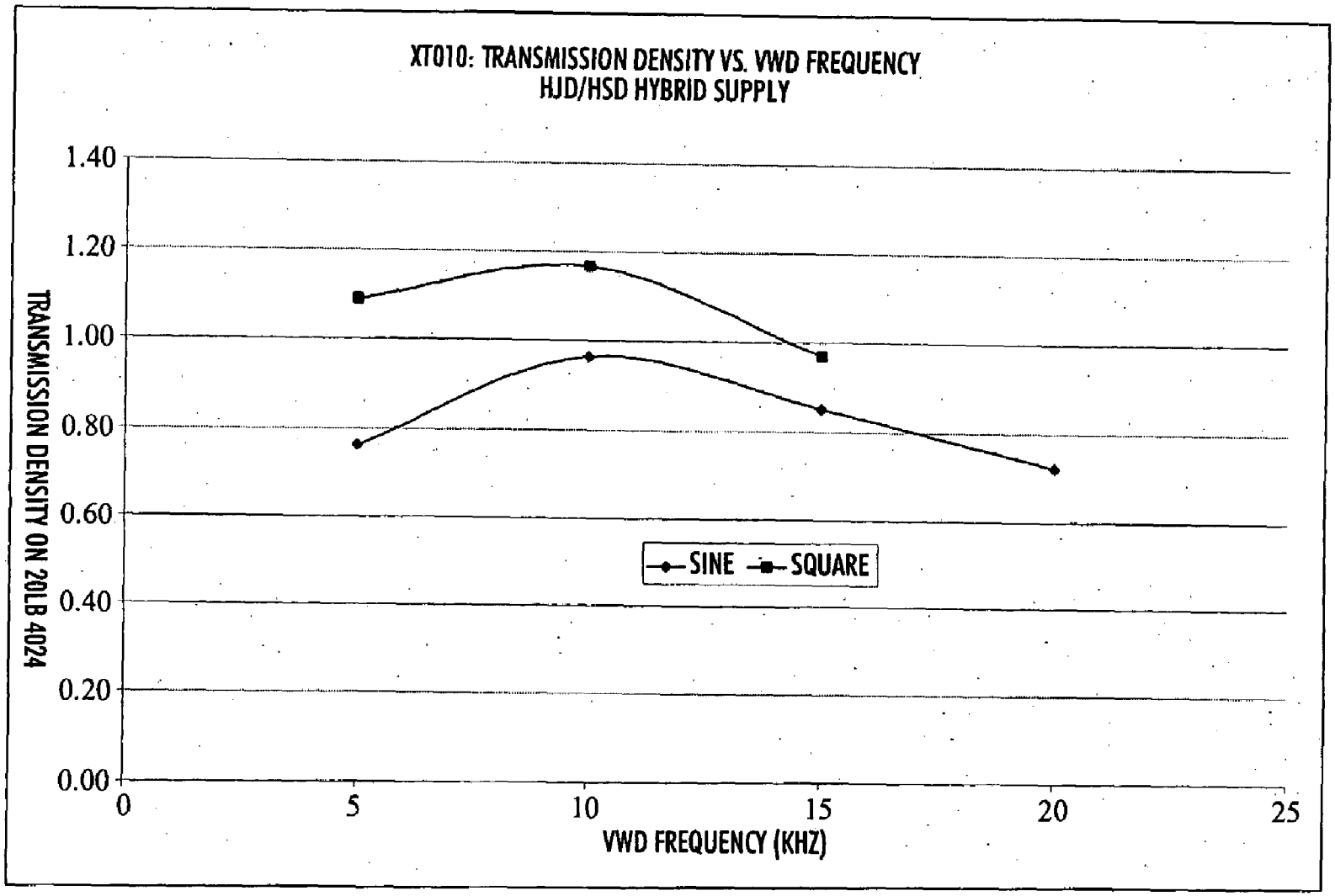
FIG. 4 is a graph illustrating toner transmission density versus frequency for sinusoidal and square AC wire voltages.

FIG. 4 illustrates experimental results obtained using the power supply configuration of FIG. 3 for sinusoidal and square waves. FIG. 4 plots transmission density of toner on a sheet, a measure of the quality of image transfer, versus $V_{WD}$ frequency. FIG. 4, shows that over the relevant frequency spectrum of five kilohertz to 15 kilohertz, transferred toner transmission density increased by as much as 37% when square waveforms were used for the AC component of the $V_{WD}$ voltage signal. This represents a significant increase in image quality with out any increase in peak voltage.

Figure 5:
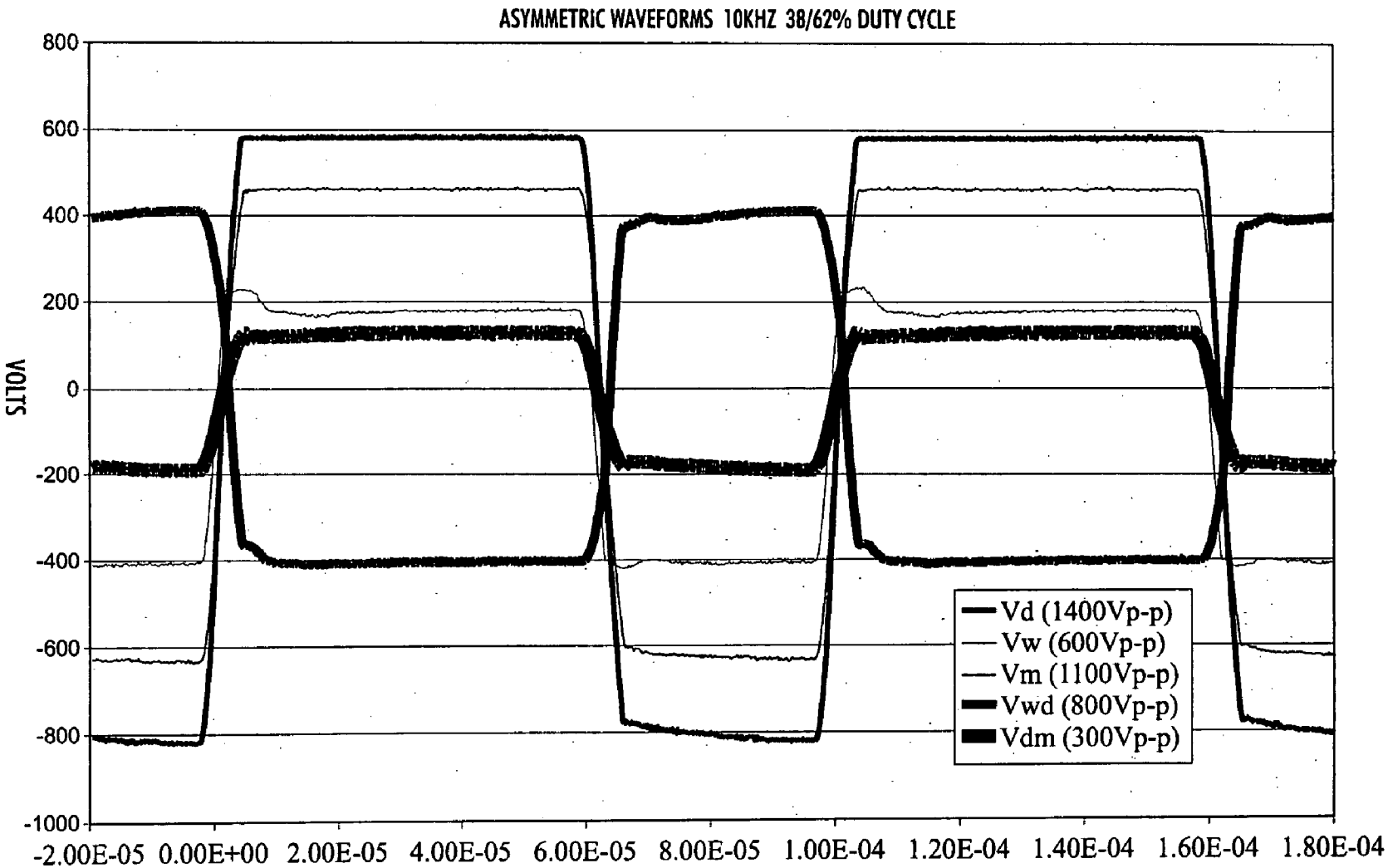
FIG. 5 is a graph of the square wave AC voltages generated by the power supply according to an exemplary embodiment of this invention.

FIG. 5 illustrates asymmetric square waveforms where the asymmetry has been adjusted to compensate for a −100 volt DC offset in VwdDC. Note that the Vwd positive and negative voltages are equal in magnitude around the zero axis. FIG. 5 shows a graph of the five voltage signals, Vw, $V_D$AC, $V_M$AC, $V_{WD}$ and VdmAC. The mag and donor AC signals are in phase, and the donor AC signal has a larger magnitude than the mag AC signal. Both VwAC, $V_m$AC and $V_d$AC are asymmetric with respect to the voltage axis. As discussed above, the asymmetric waveforms allow use of all the allowable voltage space while avoiding air breakdown between the Donor roll 40 and the electrode wires 42. $V_{WD}$AC is shown to be asymmetric about the voltage axis, producing a square wave of approximately ±400 volts in magnitude. Not shown in this single waveform snapshot is that the frequency of $V_{WD}$AC is modulated by ±2,000 hz around the 10 kilohertz center frequency. By continuously modulating the frequency of the master oscillator 215, harmonic strobing of the electrode wires 42 can be reduced and ideally prevented. The use of square wave forms allows for lower peak voltages without reducing the overall voltage because the entire voltage space is used. Lower peak voltages reduce power consumption as well as voltage stress on external components and sensors. Lower peak voltages also reduce or eliminate the possibility of voltage break down at the mag roll 46 to donor roll 40 or donor roll 40 to electrode wires 42 boundaries.

While this invention has been described in conjunction with the specific embodiments outlined above, it is evident that many alternatives, equivalents, modification and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A power supply for a developer unit for developing a latent image recorded on an image receiving member with marking particles, to form a developed image, wherein the developer unit comprises a donor member, spaced from the image receiving member, for transporting marking particles to a development zone adjacent the image receiving member; and an electrode positioned in the development zone between the image receiving member and the donor member, the power supply comprising:

a voltage supply that electrically biases said electrode, during a developing operation, with an alternating current voltage and a direct current voltage to detach marking particles from said donor member, forming a cloud of marking particles in the development zone, and developing the latent image with marking particles from the cloud;

wherein said alternating current voltage comprises waveforms having asymmetric and substantially square shapes, and wherein the alternating current is modulated by a triangle wave generated by a deviation oscillator.

2. The developer unit of claim 1, wherein said alternating current voltage is frequency modulated.

3. A printing machine having a developer unit for developing a latent image recorded on an image receiving member with marking particles, to form a developed image, the developer unit comprising:

a donor member, spaced from the image receiving member, for transporting marking particles to a development zone adjacent the image receiving member;

an electrode positioned in the development zone between the image receiving member and the donor member; and a voltage supply for electrically biasing said electrode and the donor member during a developing operation with an alternating current voltage and a direct current voltage to detach marking particles from said donor member, forming a cloud of marking particles in the development zone, and developing the latent image with marking particles from the cloud;

wherein said alternating current voltage comprises waveforms having asymmetric and substantially square shapes, and wherein said alternating current voltage for both the donor member and the electrode are run at substantially the same frequency without phase shifts.

4. The printing machine of claim 3, wherein said alternating current voltage is frequency modulated.

5. The printing machine of claim 3, wherein the alternating current is modulated by a triangle wave generated by a deviation oscillator.

6. A method of operating a donor member and an associated alternating current biased electrode in a developer unit used for developing a latent image recorded on an image receiving member with marking particles, to form a developed image, the developer having a magnetic brush member and a donor member, the donor member being spaced from the image receiving member, for transporting marking particles to a development zone adjacent the image receiving member; the alternating current biased electrode being positioned in the development zone between the image receiving member and the donor member; and a voltage supply for electrically biasing said electrode during a developing operation with an alternating current voltage and a direct current voltage to detach marking particles from said donor member, forming a cloud of marking particles in the development zone, and developing the latent image with marking particles from the cloud, the method comprising the steps of:

maintaining a relative voltage difference between the magnetic brush member and the donor member by maintaining the alternating current voltage for the donor member and the alternating current voltage for the magnetic brush member at substantially the same frequency without phase shifts;

wherein said alternating current voltage comprises waveforms having asymmetric and substantially square shapes.

7. The method of claim 6, wherein said alternating current voltage is frequency modulated.

8. The method of claim 6, further comprising modulating the alternating current voltage by a triangle wave generated by a deviation oscillator.

9. A power supply circuit for a developer unit in an image forming apparatus, the power supply circuit comprising:

at least one oscillator supplying an alternating current electrical signal;

three output terminals;

three AC drivers connected to the at least one oscillator and each supplying a voltage signal to one of the three output terminals, wherein the signal supplied by each AC driver is of the same frequency; and at least two DC power sources;

wherein said alternating current voltage comprises waveforms having asymmetric and substantially square shapes.

10. The power supply circuit according to claim 9, wherein at least one oscillator generates a frequency modulated square waveform electrical signal.

11. The power supply circuit according to claim 9, wherein the three output terminals comprise a mag roller bias, a donor roller bias and a wire electrode bias.

12. The power supply circuit according to claim 11, wherein the voltage signals supplied to the mag roller bias terminal, the donor roller bias terminal and the wire electrode are asymmetric with respect to the voltage axis.

13. The power supply according to claim 11, wherein the signals supplied to the mag roller bias terminal, the donor roller bias terminal and the wire electrode bias terminal are in phase with one another.

14. The power supply circuit according to claim 9, wherein the signal supplied by the oscillator is frequency modulated.

15. The power supply circuit according to claim 9, wherein the alternating current voltage is modulated by a triangle wave generated by a deviation oscillator.

16. A method of operating a donor member and an associated alternating current biased electrode in a developer unit used for developing a latent image recorded on an image receiving member with marking particles, to form a developed image, the developer having a magnetic brush member and a donor member, the donor member being spaced from the image receiving member, for transporting marking particles to a development zone adjacent the image receiving member; the alternating current biased electrode being positioned in the development zone between the image receiving member and the donor member; and a voltage supply for electrically biasing said electrode during a developing operation with an alternating and direct current voltage to detach marking particles from said donor member, forming a cloud of marking particles in the development zone, and developing the latent image with marking particles from the cloud, the method comprising:

maintaining a relative voltage difference between the magnetic brush member and the donor member by maintaining the alternating current voltage for the donor member and the alternating current voltage for the magnetic brush using waveforms that have asymmetric and substantially square shapes.

17. The method of claim 16, further comprising modulating the alternating current voltage by a triangle wave generated by a deviation oscillator.

* * * * *